US008298019B2

(12) United States Patent
Russo et al.

(10) Patent No.: US 8,298,019 B2
(45) Date of Patent: Oct. 30, 2012

(54) CONNECTING SYSTEM FOR IMPLEMENTING BRANCHES ON CONTINUOUS CONDUCTORS

(75) Inventors: Paulo Russo, Lage (DE); Ulrich Trapp, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 41 days.

(21) Appl. No.: 13/128,619

(22) PCT Filed: Oct. 28, 2009

(86) PCT No.: PCT/EP2009/064196
§ 371 (c)(1),
(2), (4) Date: May 17, 2011

(87) PCT Pub. No.: WO2010/057749

PCT Pub. Date: May 27, 2010

(65) Prior Publication Data

US 2011/0216545 A1 Sep. 8, 2011

(30) Foreign Application Priority Data

Nov. 19, 2008 (DE) ..... 20 2008 015 307 U

(51) Int. Cl.
*H01R 9/22* (2006.01)

(52) U.S. Cl. ..... 439/718

(58) Field of Classification Search ..... 439/709, 439/711, 712, 715, 716, 717, 718
See application file for complete search history.

(56) References Cited

U.S. PATENT DOCUMENTS

| | | | | |
|---|---|---|---|---|
| 6,120,315 | A * | 9/2000 | Gaertner et al. | 439/395 |
| 6,478,605 | B2 * | 11/2002 | Stuckmann et al. | 439/409 |
| 6,692,292 | B2 * | 2/2004 | Huiskamp et al. | 439/417 |
| 6,848,951 | B1 * | 2/2005 | Bechaz et al. | 439/716 |
| 7,192,316 | B1 * | 3/2007 | Pollmann | 439/716 |
| 7,234,961 | B2 * | 6/2007 | Arlitt et al. | 439/410 |
| 7,407,406 | B2 * | 8/2008 | Arlitt et al. | 439/404 |
| 7,491,084 | B2 * | 2/2009 | Wedler et al. | 439/404 |
| 7,491,096 | B1 * | 2/2009 | Correll | 439/716 |
| 7,553,199 | B2 * | 6/2009 | Correll | 439/715 |
| 7,753,739 | B2 * | 7/2010 | Bentler et al. | 439/709 |
| 2006/0258226 | A1 | 11/2006 | Milan | |
| 2007/0066121 | A1 * | 3/2007 | Arlitt et al. | 439/404 |
| 2007/0066123 | A1 * | 3/2007 | Arlitt et al. | 439/409 |
| 2008/0096416 | A1 * | 4/2008 | Wedler et al. | 439/389 |
| 2009/0181582 | A1 * | 7/2009 | Thompson | 439/709 |

(Continued)

FOREIGN PATENT DOCUMENTS

| | | | |
|---|---|---|---|
| DE | 29706750 | U1 | 7/1997 |

(Continued)

*Primary Examiner* — Ross Gushi
(74) *Attorney, Agent, or Firm* — Lawrence E. Laubscher, Sr.; Lawrence E. Laubscher, Jr.

(57) ABSTRACT

A housing for connecting a plurality of branch lines to the insulated conductors of an intermediate portion of a cable from which the outer sheath layer has been removed, comprising a rectangular base member containing an open-topped base chamber, and a pair of opposed end walls containing openings for receiving spaced insulated portions of the cable on opposite sides of the cable intermediate portion. A plurality of insulation-piercing electrical devices are arranged in the base chamber in electrical engagement with the insulated conductors, respectively, and a plurality of interchangeable cover members are each adapted for seating on the base member to close the base chamber, with each of the cover members containing an electrical component arranged for connection with at least one of the electrical devices.

16 Claims, 13 Drawing Sheets

U.S. PATENT DOCUMENTS

| | | | | |
|---|---|---|---|---|
| 2010/0167573 | A1* | 7/2010 | Dhandapani et al. | 439/345 |
| 2010/0203773 | A1* | 8/2010 | Henke et al. | 439/709 |
| 2011/0216545 | A1* | 9/2011 | Russo et al. | 362/362 |

FOREIGN PATENT DOCUMENTS

| | | | |
|---|---|---|---|
| DE | 29708222 | U1 | 10/1998 |
| DE | 20100300 | U1 | 5/2001 |
| DE | 20214132 | U1 | 1/2003 |
| DE | 10142477 | A1 | 4/2003 |
| EP | 1764870 | A1 | 3/2007 |
| EP | 1843441 | A2 | 10/2007 |
| EP | 1764871 | B1 | 4/2008 |
| EP | 1914840 | A2 | 4/2008 |

* cited by examiner 3c
15
2

PRIOR ART

CONNECTING SYSTEM FOR IMPLEMENTING BRANCHES ON CONTINUOUS CONDUCTORS

REFERENCE TO RELATED APPLICATIONS

This application is a continuation application of International Application No. PCT/EP2009/064196 filed Oct. 28, 2009, based on German application No. 20 2008 015 307.7 filed Nov. 19, 2008.

BACKGROUND OF THE INVENTION

1. Field of the Invention

A housing for connecting a plurality of branch lines to the insulated conductors of an intermediate portion of a cable from which the outer sheath layer has been removed, including a rectangular base member containing an open-topped base chamber receiving the conductors in a fanned out arrangement, a plurality of insulation-piercing electrical devices arranged in the base chamber in electrical engagement with the insulated conductors, respectively, and a plurality of interchangeable cover members each adapted for seating on the base member to close the base chamber, each of said cover members containing an electrical component connected with at least one of the electrical devices.

2. Description of Related Art

As shown by the German patent No. DE 297 08 222 U1, it is known in the prior art to provide a connection device for connecting branch lines to a plurality of continuous insulated conductors without having to cut the conductors. For this purpose, on a base plate, there is provided a plurality of groove-like seats in which one can insert either a flat cable or a plurality of parallel electrical conductors. Then a top part is applied in order to slacken the conductors or the flat cable. Upon this preassembled unit, which is provided with partitions, there are locked clamp-like bodies, which bodies in each case are provided with an insulation-penetrating contacts that are connected via a bus bar with two female terminals for connection with the associated branch conductors. In this way, one can each time make two branch lines on each conductor without having to cut the continuous conductors.

Additionally, the European patents Nos. EP 0 1 764 870 A1 and EP 1 764 871 B1 show connection devices which, compared to the above-mentioned state of the art, were definitely further developed and which are distinguished especially by a definitely optimized handling function and by high achievable wiring forces. European patent No. EP 1843 441 A2 furthermore discloses a particularly advantageous sealing means for the housing passage for cables, such as are displayed, for example, by the connection devices disclosed by EP 0 1 764 870 A1 and EP 1 764 871 B1.

Finally, the European patent No. EP 1 914 840 A2 (which corresponds with the U.S. patent to Wedler et al U.S. Pat. No. 7,491,084) shows a connection system with several connection devices that can be assembled to form subassemblies.

Starting with the basic connection arrangement of the European patent No. EP 0 1 914 840 A2, the present invention was developed to supplement the connection system disclosed in this publication by further advantageous features.

SUMMARY OF THE INVENTION

Accordingly, a primary object of the present invention is to provide a housing for connecting a plurality of branch lines to the insulated conductors of an intermediate portion of a cable from which the outer sheath layer has been removed, including a rectangular base member containing an open-topped base chamber receiving the insulated conductors in a fanned-out manner, a plurality of insulation-piercing electrical devices arranged in the base chamber in electrical engagement with the insulated conductors, respectively, and a plurality of interchangeable cover members each of which contains an electrical component adapted for connection with at least one of the electrical devices when the cover member is seated on the base member.

Preferably the cover member is formed of a transparent synthetic plastic material, so that when the electrical component mounted in the cover is a printed circuit board carrying an energized light emitting diode, the component serves as a lamp for illuminating the area around a selected intermediate point on the continuous cable.

In other embodiments, the cover member contains a physical-condition sensing circuit, a fuse panel or the like. The cover member may be provided with one or more wall openings in which are mounted plug or socket connectors having terminals connected with the branch conductors. The cover member may also be provided with integral cooling ribs or fins.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 13:
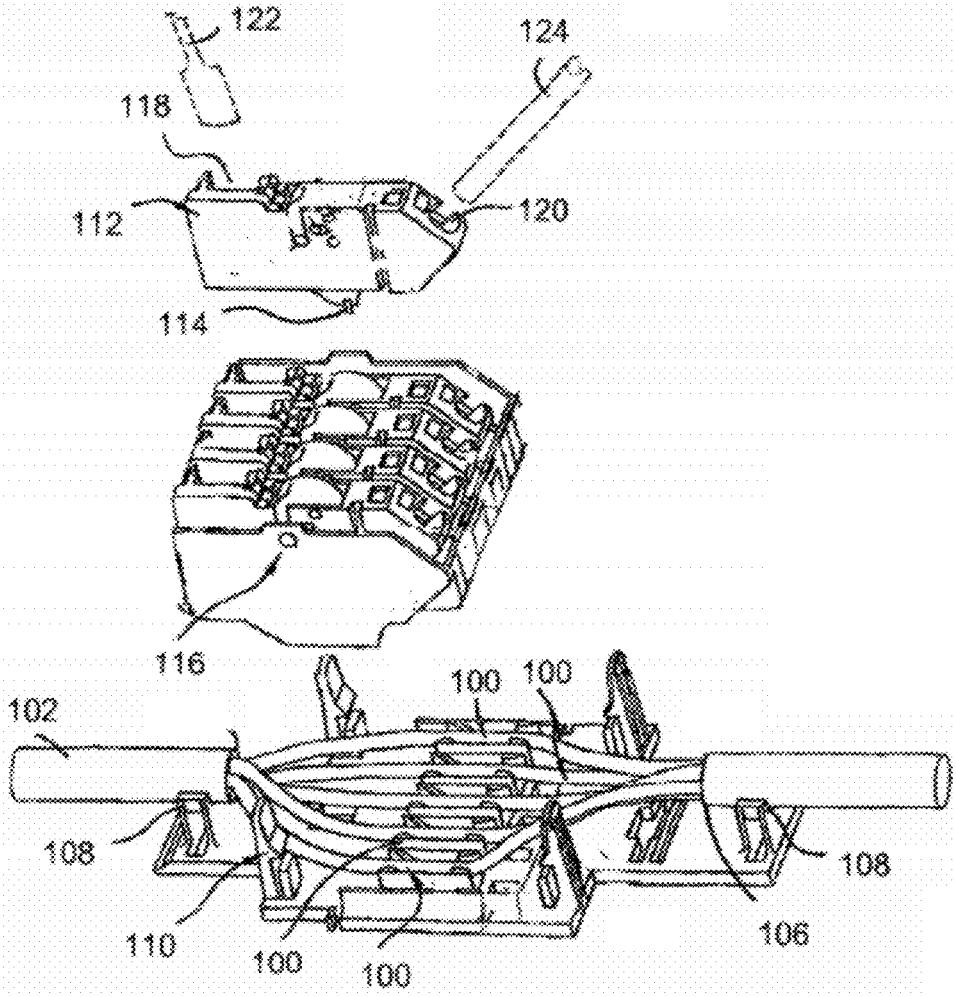
FIG. 13 is an exploded view of the prior art connector arrangement of the Wedler et al U.S. Pat. No. 7,491,084.

Referring first more particularly to FIG. 13, as shown by the Wedler et al U.S. Pat. No. 7,491,084, it is known in the prior art to connect branch lines to the fanned-out insulated conductors 100 of a cable 102 having an intermediate portion 104 from which is removed the cable sheath layer 106. Portions of the cable on opposite sides of the intermediate portion are supported by the arms 108 of a support frame 110, and a plurality of terminal blocks 112 are provided having insulation-piercing contacts 114 in engagement with the conductors of the insulated wires 100, respectively. The terminal blocks are supported as a unit by a holder 116 mounted in the frame 110. The terminal blocks contain openings 118 and 120 for connection with the tapped-off output branch lines 122 and 124, respectively. that are connected with various electrical components.

Figure 1:
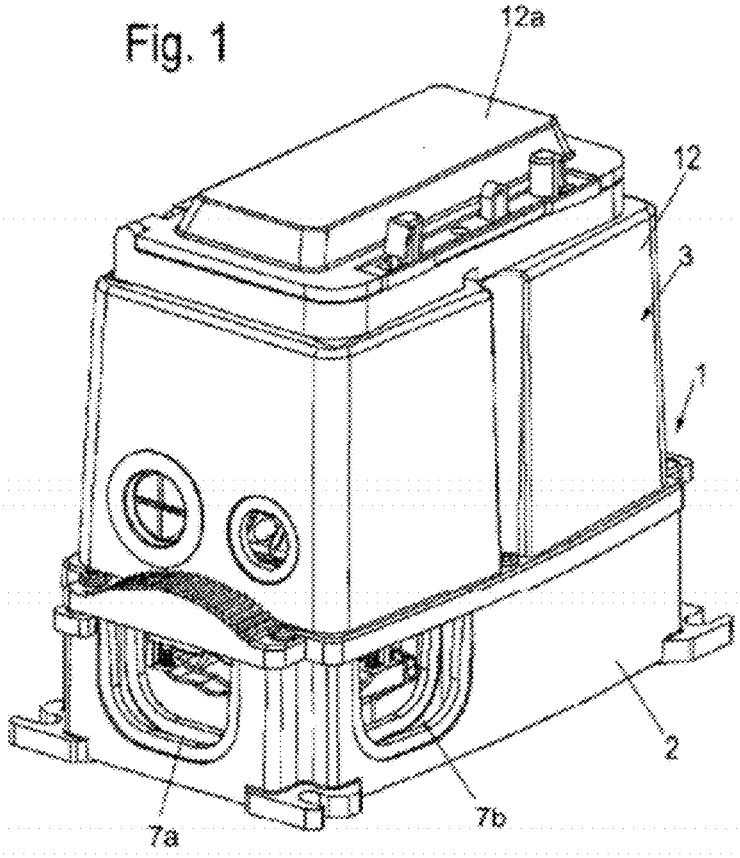
FIGS. 1 and 2 are front perspective and exploded views, respectively, of a first embodiment of the housing of the present invention.
Figure 2:
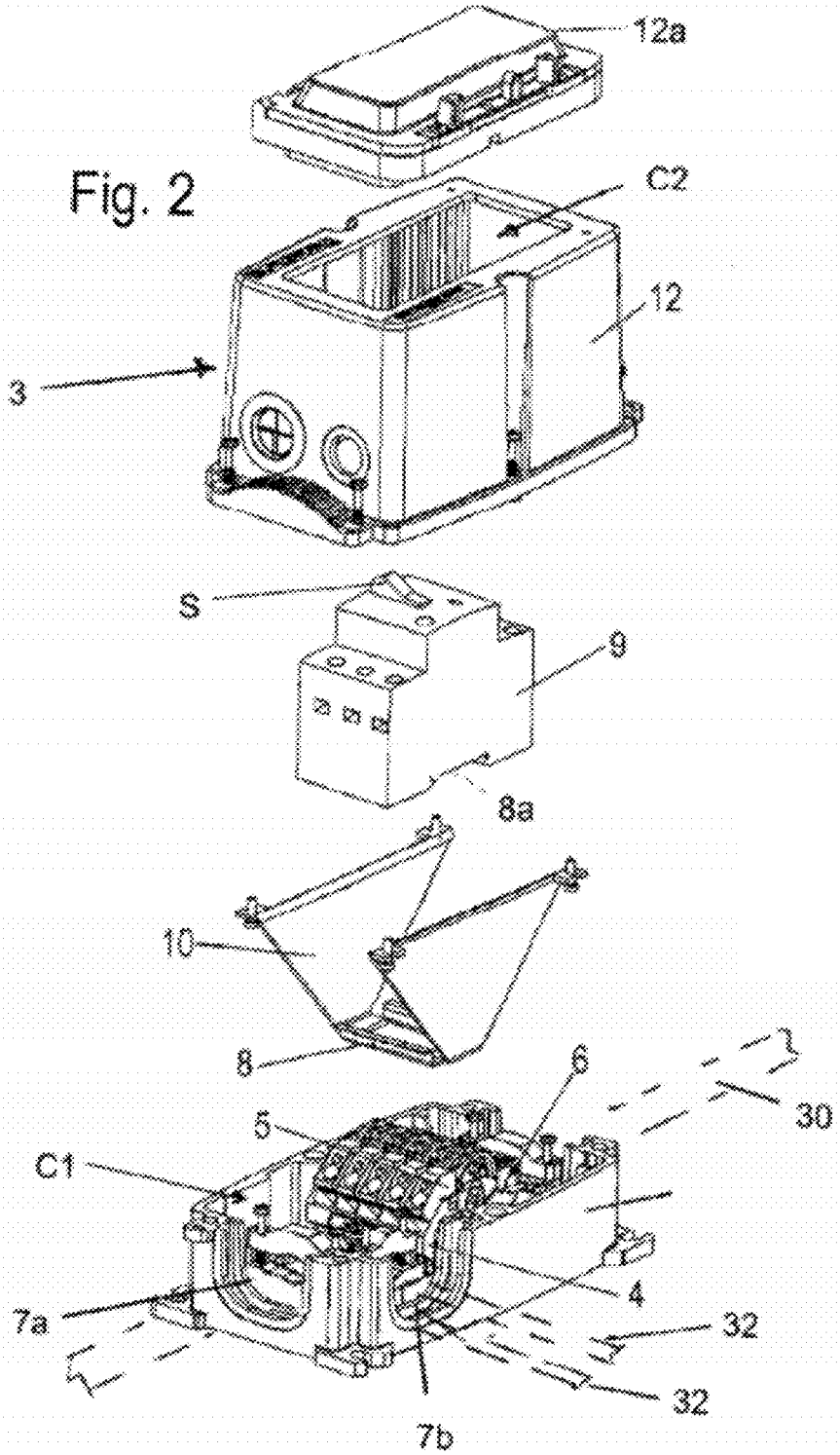

Referring now to FIGS. 1 and 2, in accordance with the present invention, a sectional housing 1 is provided having a base member 2 containing an open-topped chamber C1, and a cover member 3 containing a chamber C2 that is open at its bottom, and is closed at its top by an access lid 12*a* that is removably connected with the cover side and end wall unit 12. The bank of terminal blocks 5 is mounted in the receiving space 6 defined within base chamber C1, which terminal blocks have insulation piercing contacts that are in electrical contact with the continuous conductors of the stripped intermediate portion of the cable 30.

In accordance with a characterizing feature of the invention, an electrical component 9 is mounted within the cover 3 for connection with the tapped-off branch lines at selected output contacts of the terminal blocks 5. In the illustrated embodiment, the U-shaped support strap 10 is provided with an inverted hat-shaped mounting rail 8 that engages the corresponding mounting slot 8*a* contained in the electrical component 9, which in this case is a manually operated switch S. Upon removal of the access lid 12*a,* the switch S is operated between its on and off positions. Preferably, the cover wall unit 12 and the lid 12*a* are formed from a transparent synthetic plastic material.

Regarding the structure of the internal connection technique of the connection modules, one might by way of example refer to EP 0 1 764 870 A1 and EP 1 764 871 B1. The essential thing here is at least one of the internal connection modules of the connection devices of the system is so designed that with its help, one can make branch lines on the fanned-out conductors of a stripped portion of the continuous cable for which purpose, at any rate, this connection module preferably has insulation-penetrating contacts.

Base member 2 and housing member 3 in the assembled state contain several housing passages 7, passing through the top housing from the inside to the outside for the continuing cable 30 and for the outgoing conductors or cable 32. In the area of the housing passages 7, one can make walls that can be broken out along indicated rupture lines in order to comply with the most varied installation situations. Passages 7 are sealed (not shown here) by seals that are preferably retained in a foldable manner on a film hinge and which are preferably radially divided.

FIGS. 1 and 2 show how the arrangement works. First of all, a portion of the cable outer sheath is stripped where the branch lines are to be installed. Then the conductors are fanned out and placed in the seats and the cables are fixed in the area that is not stripped, whereupon the conductors are contacted preferably with insulation-penetrating conductors. The insulation penetrating contacts again are preferably connected with plugs or sockets that are used for contacting with conductors or with an electronic unit or the like.

The arrangement is very clear and can be handled in a simple and safe manner, whereby by means of the preferably employed eccentric arrangement, which is braced on the module frame, one can achieve particularly high wiring forces.

As mentioned earlier in the typical EP 1 914 840 A2, a particularly advantageous connection system can be made in the following manner: We provide differently shaped and designed housing lids 3.

In this way, by merely exchanging the housing lids 3, one can make connection devices for the most varied functions, which then together constitute a connection system.

For instance, housing cover member 3 can serve as a mere [bare] cover.

According to a variant of a housing cover member 3 shown in FIGS. 1 and 2, it is provided, on the other hand, to arrange in the interior space of housing cover member 3 a mounting rail piece 8 with a hat-shaped cross-section that is designed to receive one or several housings 9 for the purpose of locking upon mounting rails.

Preferably, housing 9 is an electronic housing to receive a power electronics, such as it is used, for example, for starting electric motors.

Between terminal block 4 and housing 9, one can make a conducting connection by means of short conductor pieces. In this way, housing 9 is in a simple manner housed in the housing lid and thus in the top housing, which is preferably made with a high degree of sealing effect.

The mounting rail strap can be arranged or attached on a mount 10, which can be fixed, especially can be screwed in a fixed manner, on the inside of housing lid 3.

Housing cover member 3 can be made in the form of one part—or as shown in FIG. 1—in the form of several parts. In a particularly preferred manner, the housing lid has an outer frame 12 and a lid 12*a*.

The entire housing member 3 or the preferably foldable lid 12*a* are made according to another—also independently considered—variant of the invention by using transparent materials.

The interior of the top housing can be observed very well through this transparent cover member 3, for example, to check on any readings or invitations.

Figure 3:
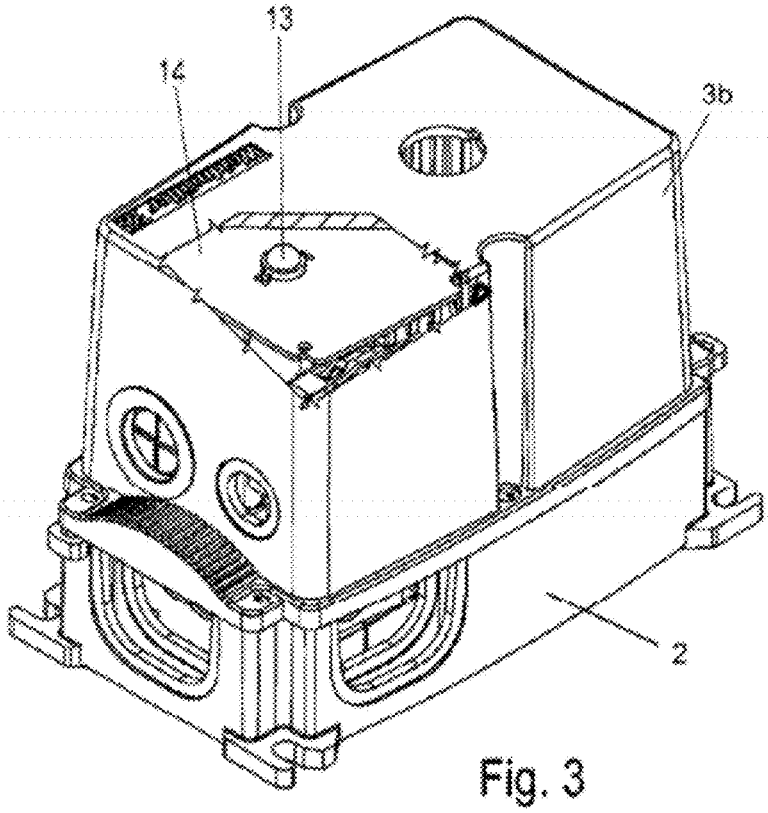
FIGS. 3 and 4 are front perspective and exploded views, respectively, of a second embodiment of the invention.
Figure 4:
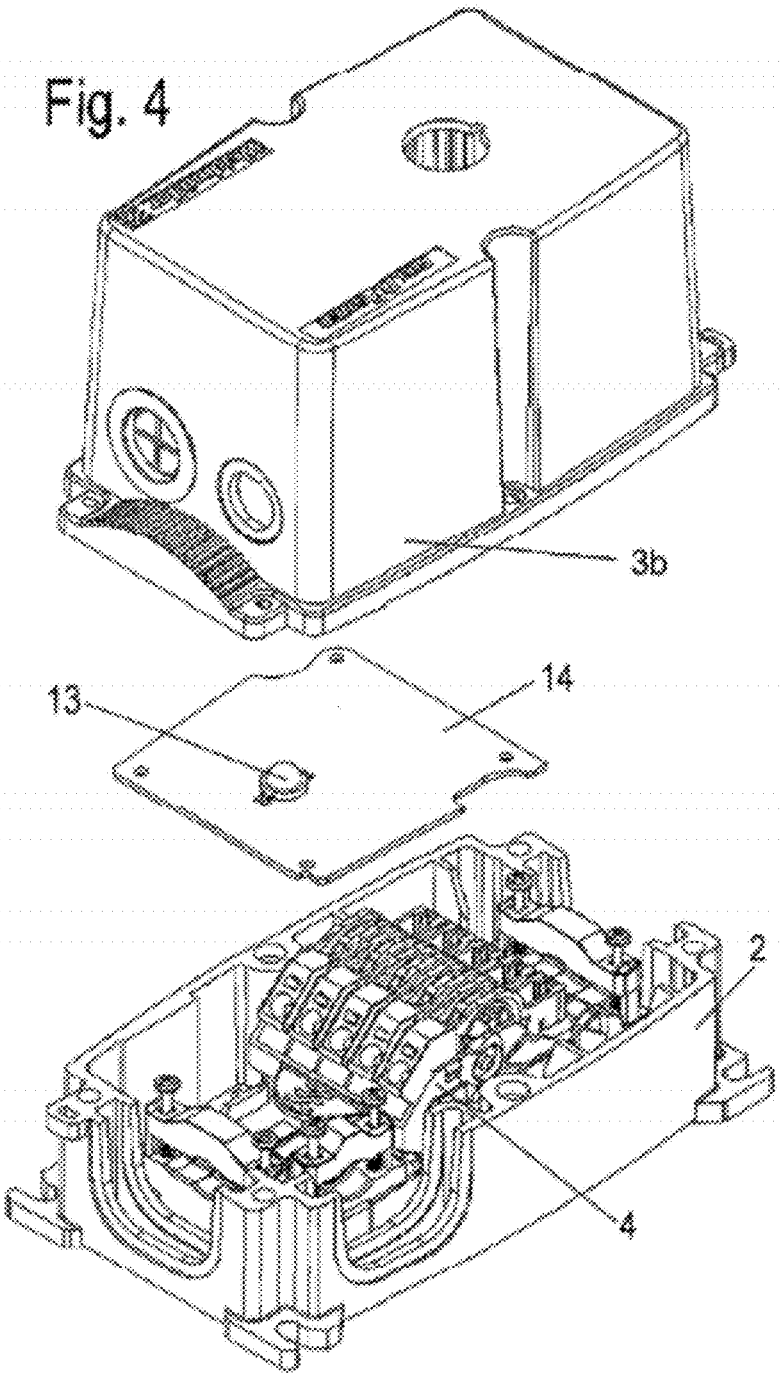

Referring now to FIGS. 3 and 4, a transparent interchangeable cover 3*b* is provided for connection with the base member 2 of FIG. 1. In this case, the electrical component mounted within the cover member 3*b* is a printed circuit board 14 upon which is connected a light emitting diode 13. In this case, when the light emitting diode (LED) is energized, luminous energy is produced which illuminates the area around the portion of the continuous cable to which the housing is connected.

Figure 5:
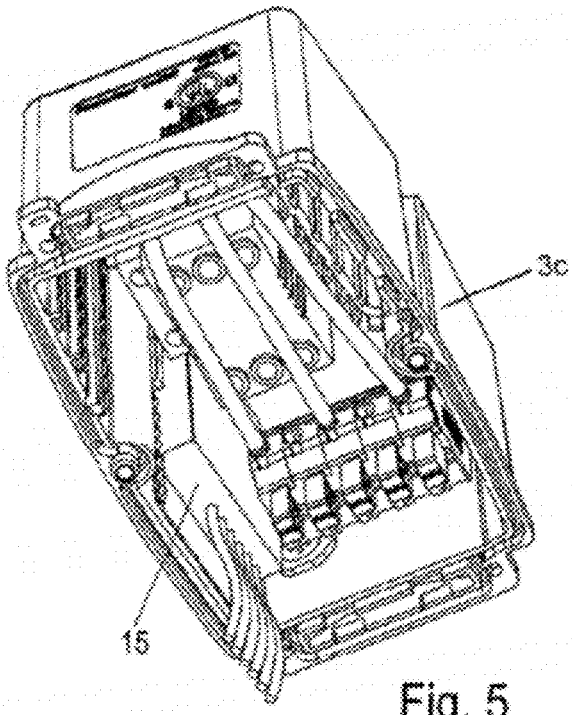
FIGS. 5 and 6 are bottom perspective and exploded views, respectively, of another embodiment of the invention.
Figure 6:
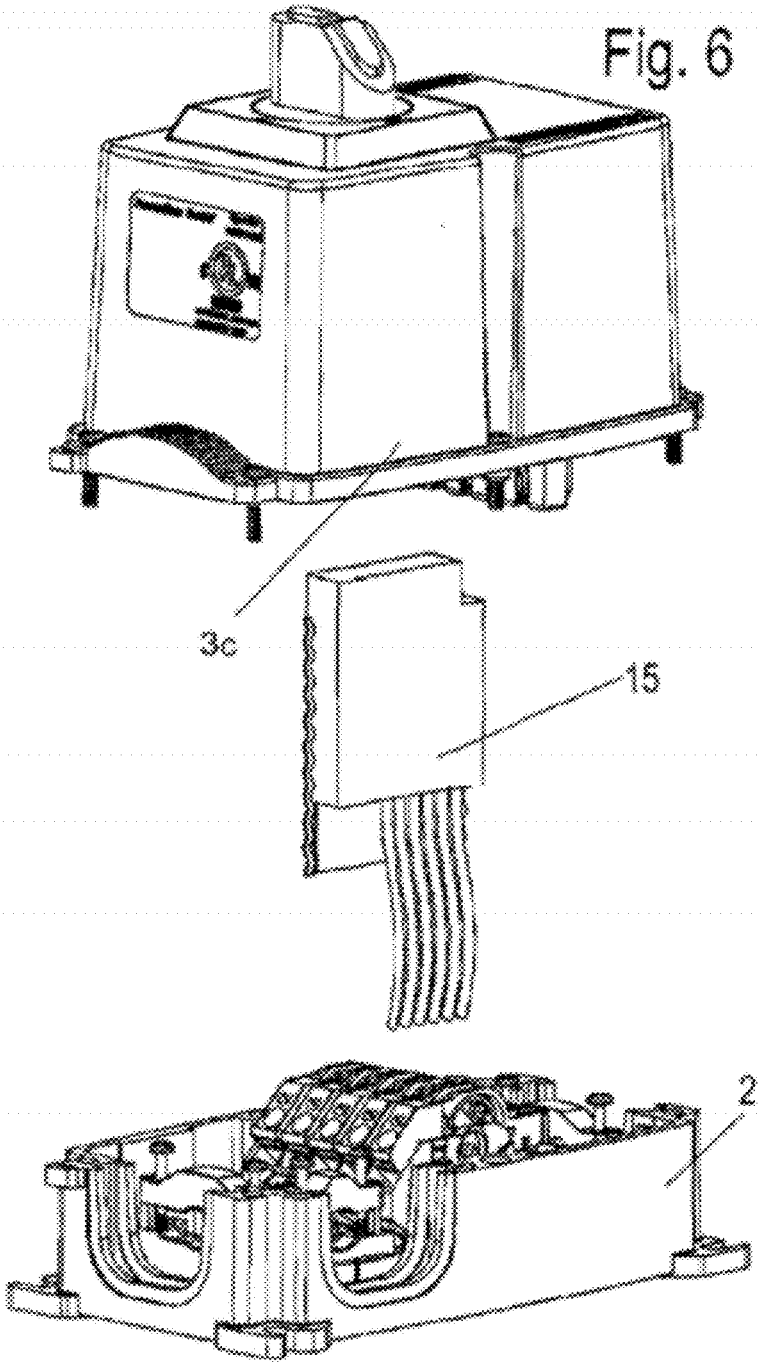
Figure 7:
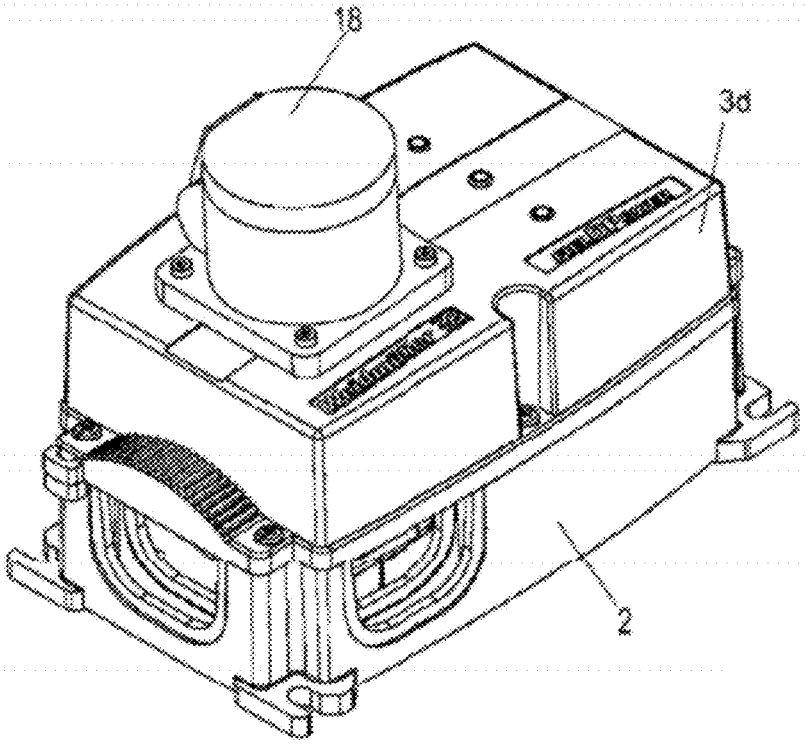
FIGS. 7 and 8 are front perspective and exploded views of a further embodiment of the invention.
Figure 8:
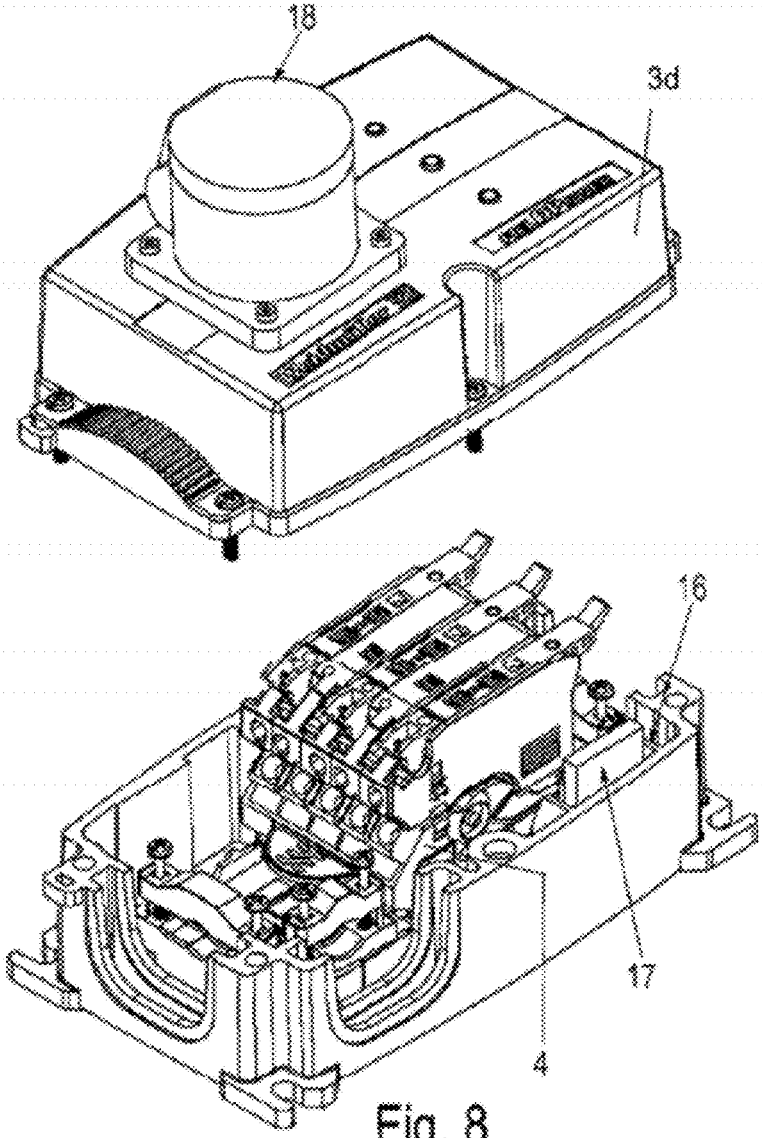
Figure 9:
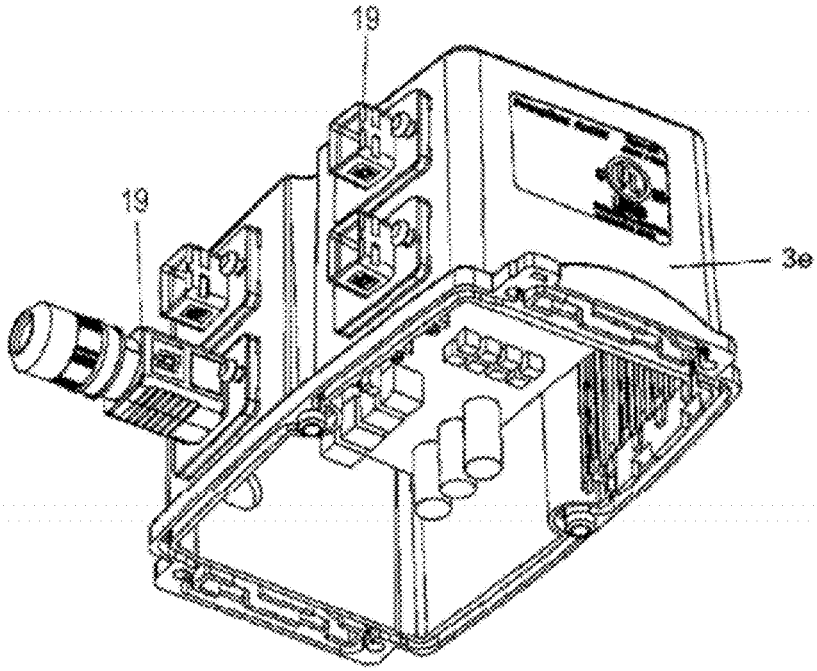
FIGS. 9 and 10 are bottom perspective views of still other embodiments of the invention.
Figure 10:
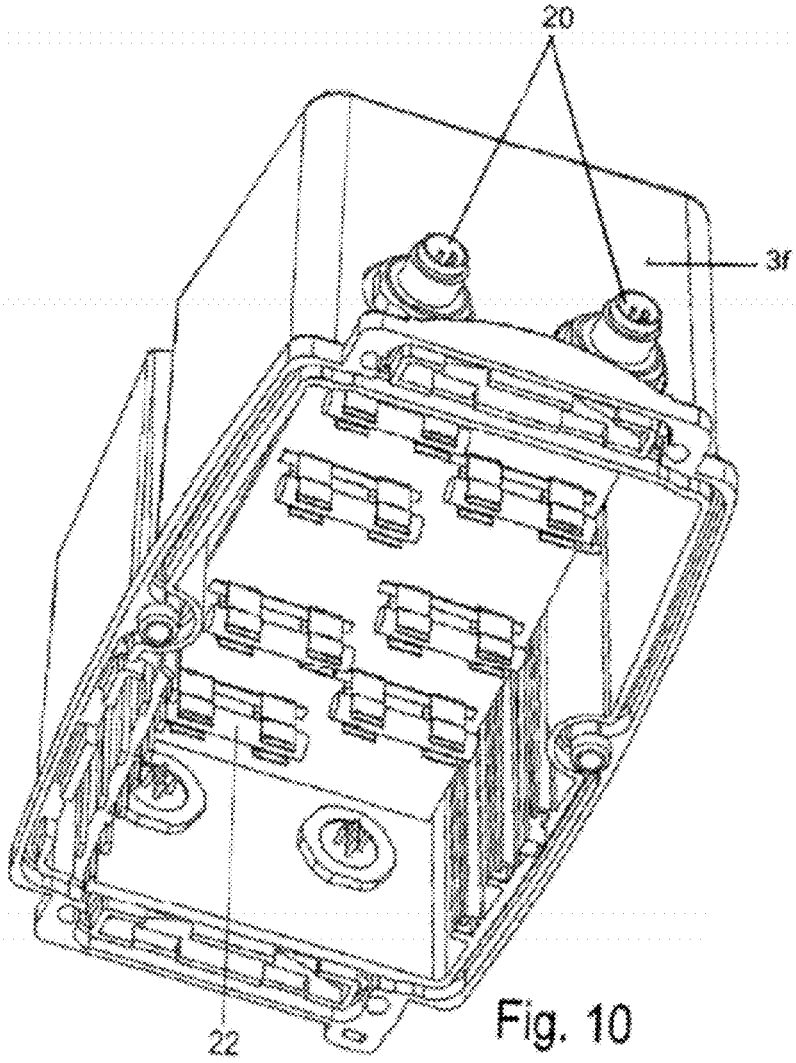

In the embodiment of FIGS. 5 and 6, an electrical component such as a condition sensing device 15 is mounted in a pocket contained in the cover chamber, and in the embodiment of FIGS. 7 and 8, the cover member 3*d* is provided with a plug or socket connector 18 that is connected with the output terminals of the terminal block bank via a corresponding opening contained in the cover top wall. FIG. 8 illustrates that it is possible furthermore to integrate into the housing lid a bay 16, which can be used to receive a spare parts container, for example, a fuse box 17. In the embodiment of FIG. 9, the connectors 19 are of the RJ45 type, and in the embodiment of FIG. 10, the connectors 20 are of the M-standard type (such as M6, M8, M12, or the like). It will be noted that in the embodiment of FIG. 10, a fuse panel supporting a plurality of fuses 22 is also mounted in the cover member 3*f.*

Figure 11:
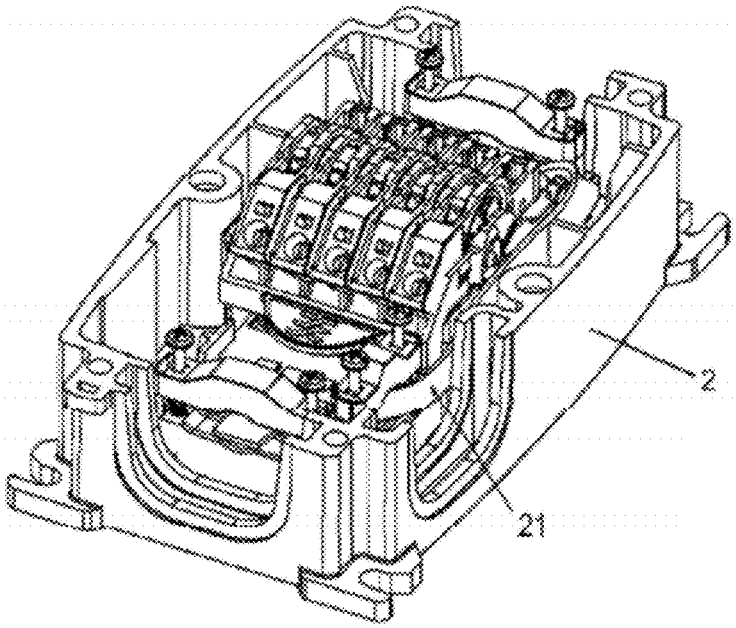
FIG. 11 illustrates a feature regarding the base member of the present invention.
Figure 12:
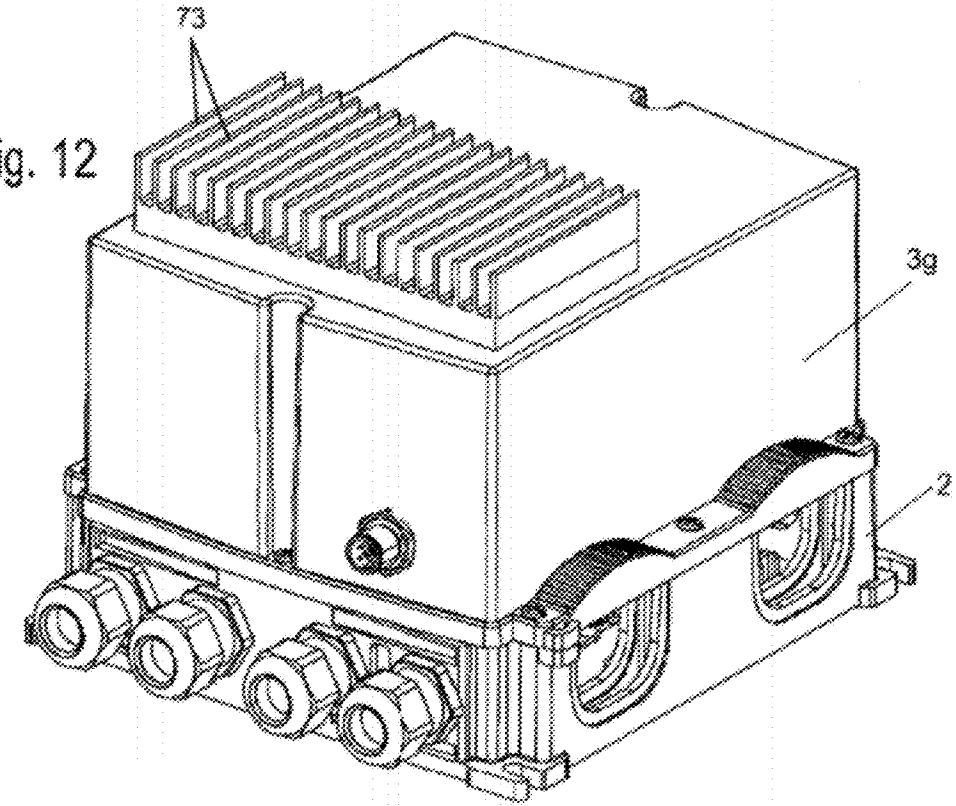
FIG. 12 is a front perspective view of another embodiment of the invention.

In the modification shown in FIG. 11, the base member 2 is provided with a ground strap 21, and in the embodiment of FIG. 12, the cover member is provided with a plurality of cooling fins 73.

The two internal connection modules, for example, can be connected with each other by means of conductors. It is also conceivable that one can place on one of the power modules a kind of transformer and/or a rectifier circuit in order to make a kind of feeder station for a direct voltage of, for example, 24 V, which is applied to the continuing cable by one of the two connection modules, while the continuous cable of the other connection module is used for transmitting a higher alternating voltage or the like.

While in accordance with the provisions of the Patent Statutes the preferred forms and embodiments of the invention have been illustrated and described, it will be apparent to those skilled in the art that changes may be made without deviating from the invention described above.

What is claimed is:

1. A housing for connecting a plurality of branch lines to the fanned out insulated conductors of an intermediate portion of a cable from which the outer sheath layer has been removed, comprising:

(a) a rectangular base member (2) having a horizontal bottom wall, and opposed pairs of vertical side and end walls extending upwardly from said bottom wall to define an open-topped base chamber, said end walls containing first openings (7*a*) for receiving spaced insulated portions of the cable on opposite sides of the cable intermediate portion when the cable intermediate portion is arranged in said base chamber;

(b) a plurality of electrical devices (5) arranged in said chamber, said electrical devices having insulation piercing contacts in electrical engagement with said insulated conductors, respectively;

(c) a plurality of interchangeable cover members (3*a*- 3*g*) each adapted for seating on said base member to close said base chamber, each of said cover members including side, end and top walls defining a cover chamber, at least one of said base and cover walls containing an outlet opening (7*b*) for receiving outlet branch lines connected with said electrical components, respectively; and (d) an electrical component (9; 13, 15; 17; 22) mounted in said cover chamber for connection with at least some of said electrical devices.

2. A housing as defined in claim 1, wherein said cover member is formed from a transparent material.

3. A housing as defined in claim 2, wherein said electrical component comprises a printed circuit board (14), and a light emitting diode (13) connected with said printed circuit board.

4. A housing as defined in claim 2, wherein said electrical component comprises a manually operable switch (S).

5. A housing as defined in claim 1, wherein said cover member includes a removable transparent access lid portion (12*a*).

6. A housing as defined in claim 1, and further including rail support means (10) for mounting said electrical component in said cover chamber.

7. A housing as defined in claim 1, wherein said cover member contains a bay (16) for receiving spare parts.

8. A housing as defined in claim 1, wherein said electrical component comprises a condition sensing device (15).

9. A housing as defined in claim 1, and further including a connector (18) mounted in said outlet opening, said connector being connected with said outlet branch conductors.

10. A housing as defined in claim 9, wherein said connector is an AS-i energy and data bus connector.

11. A housing as defined in claim 9, wherein said connector is a RJ4 connector.

12. A housing as defined in claim 9, wherein said connector is an M-standard connector.

13. A housing as defined in claim 1, wherein said electrical component is a fuse panel containing a plurality of fuses (22).

14. A housing as defined in claim 1, wherein said base member includes a ground strap (21).

15. A housing as defined in claim 1, wherein said cover member includes a plurality of cooling ribs (73).

16. A housing as defined in claim 1, wherein each of said electrical devices is a terminal block.

* * * * *